US012078042B2

(12) United States Patent
Moreira Branco et al.

(10) Patent No.: US 12,078,042 B2
(45) Date of Patent: Sep. 3, 2024

(54) INTEGRATED SYSTEM FOR SUBSEA HEATING AND PUMPING OF OIL AND WATER INJECTION FOR RESERVOIR PRESSURIZATION, AND METHOD OF HEATING, OF SUBSEA PUMPING HYDRAULICALLY ACTUATED AND WATER INJECTION

(71) Applicant: PETRÓLEO BRASILEIRO S.A.—PETROBRÁS, Rio de Janeiro (BR)

(72) Inventors: Celso Cesar Moreira Branco, Rio de Janeiro (BR); Tatiane Silva Vieira, Rio de Janeiro (BR); Jonatas Ribeiro; Michele Cristina Pedroso, Rio de Janeiro (BR); Roberto Rodrigues, Rio de Janeiro (BR)

(73) Assignee: PETRÓLEO BRASILEIRO S.A.—PETROBRÁS, Rio de Janeiro RJ (BR)

( * ) Notice: Subject to any disclaimer, the term of this patent is extended or adjusted under 35 U.S.C. 154(b) by 0 days.

(21) Appl. No.: 17/637,696

(22) PCT Filed: Aug. 18, 2020

(86) PCT No.: PCT/BR2020/050327
§ 371 (c)(1),
(2) Date: Feb. 23, 2022

(87) PCT Pub. No.: WO2021/035319
PCT Pub. Date: Mar. 4, 2021

(65) Prior Publication Data

US 2022/0290541 A1 Sep. 15, 2022

(30) Foreign Application Priority Data

Aug. 23, 2019 (BR) ..... 102019017643-1

(51) Int. Cl.
*E21B 43/017* (2006.01)
*E21B 43/12* (2006.01)
(Continued)

(52) U.S. Cl.
CPC ..... *E21B 43/24* (2013.01); *E21B 43/017* (2013.01); *E21B 43/121* (2013.01); *E21B 43/20* (2013.01)

(58) Field of Classification Search
CPC ..... E21B 43/017; E21B 43/121; E21B 43/20; E21B 43/24
See application file for complete search history.

(56) References Cited

U.S. PATENT DOCUMENTS 4,967,843 A * 11/1990 Corteville ..... E21B 43/01 166/54.1
7,249,634 B2 7/2007 de Albuquerque Lima Goncalves et al.
(Continued)

FOREIGN PATENT DOCUMENTS

BR 102013019601 A2 10/2015
GB 2 358 202 A 7/2001
(Continued)

OTHER PUBLICATIONS

International Search Report, issued in PCT/BR2020/050327, dated Oct. 8, 2020.
(Continued)

*Primary Examiner* — Matthew R Buck
(74) *Attorney, Agent, or Firm* — Birch, Stewart, Kolasch & Birch, LLP

(57) ABSTRACT

The present invention is related to artificial lifting systems and production flow assurance from subsea oil wells. In this sense, the present invention provides an integrated subsea oil heating and pumping system hydraulically actuated by
(Continued)

heated injection water, the system comprising at least one recoverable pumping module connected to a subsea base which, in turn, receives the produced fluids from at least one subsea producing well. The subsea base is connected to a production unit through a riser through which the produced oil flows and to an injection line that feeds the pumping module with water which, after activating the turbine and pump set, is injected through at least one injection well. The present invention further provides a hydraulically actuated subsea pumping method associated with the system described above.

4 Claims, 5 Drawing Sheets

(51) Int. Cl.
*E21B 43/20* (2006.01)
*E21B 43/24* (2006.01)

(56) References Cited

U.S. PATENT DOCUMENTS

| | | | | |
|---|---|---|---|---|
| 9,435,186 | B2 * | 9/2016 | Bakke | E21B 43/40 |
| 10,711,935 | B2 * | 7/2020 | Settouti | F16L 53/34 |
| 2011/0158824 | A1 * | 6/2011 | Wright | B01D 19/0042 417/375 |
| 2011/0232912 | A1 * | 9/2011 | Close | E21B 43/01 166/357 |

FOREIGN PATENT DOCUMENTS

| | | | | |
|---|---|---|---|---|
| WO | WO 01/65065 | A1 | 9/2001 | |
| WO | WO 2015/000447 | A1 | 1/2015 | |
| WO | WO-2015197817 | A2 * | 12/2015 | E21B 36/00 |
| WO | WO 2018/203070 | A1 | 11/2018 | |

OTHER PUBLICATIONS

Written Opinion of the International Searching Authority, issued in PCT/BR2020/050327, dated Oct. 8, 2020.

* cited by examiner

Figure 2
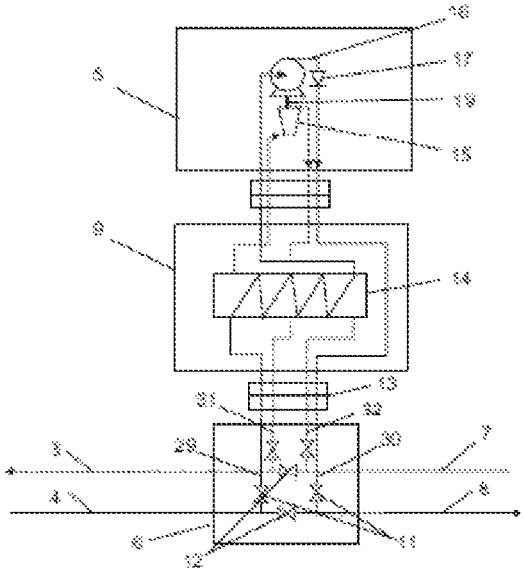
Fig. 2A
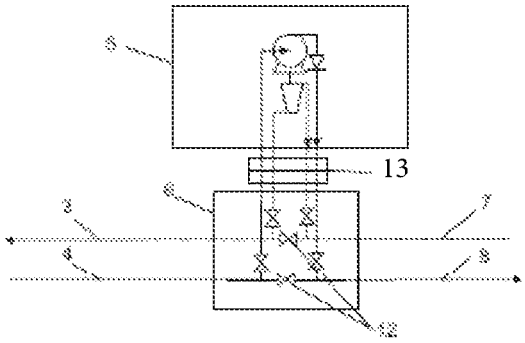
Fig. 2B

Figure 5
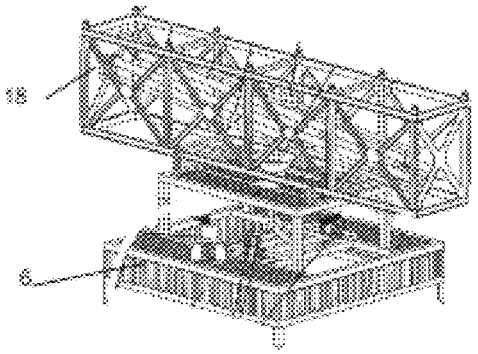
Fig. 5A
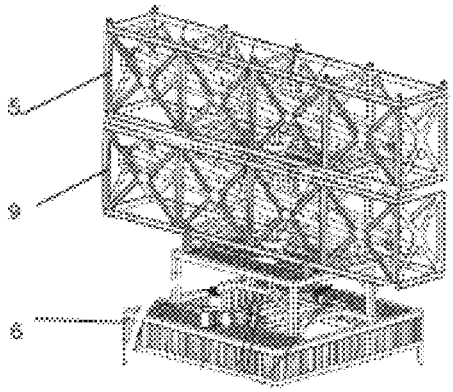
Fig. 5B
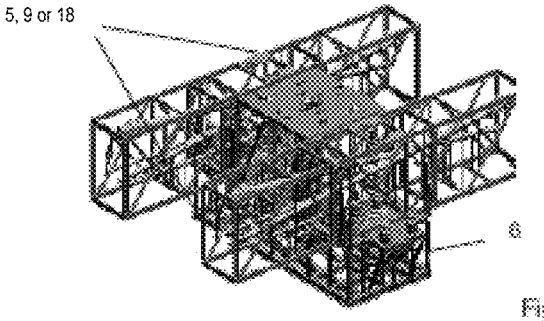
Fig. 5C

INTEGRATED SYSTEM FOR SUBSEA HEATING AND PUMPING OF OIL AND WATER INJECTION FOR RESERVOIR PRESSURIZATION, AND METHOD OF HEATING, OF SUBSEA PUMPING HYDRAULICALLY ACTUATED AND WATER INJECTION

FIELD OF INVENTION

The present invention is related to oil lifting and water injection systems for maintaining production flow rate and pressurization of oil reservoirs in subsea fields.

DESCRIPTION OF PRIOR ART

During the oil production process at sea, especially in deep waters, several systems and equipment have been developed to provide energy to oil, both in the form of pressure and in the form of heat, aiming to facilitate and increase the flow rates produced to the surface.

In subsea fields, it is common to inject water, from the sea and produced water, to maintain reservoir pressure, preserve production levels and improve the recovery factor.

Currently, for subsea wells, whenever the pressure conditions and amount of free gas are favorable, pumps are preferably installed outside the producing well, on the seabed. This configuration facilitates the installation of the pump and eventual replacement in case of failure. Examples of this practice are described in patent documents U.S. Pat. Nos. 7,314,084 and 7,516,795, where pumps driven by an electric motor of the BCS type are installed outside the production well.

Also, in document U.S. Pat. No. 8,857,519 a method of modernization of production systems is proposed, popularly known as retrofitting, where electrically driven subsea pumping and separation systems can be installed and lowered through production risers.

Document BR 10 2017 009298-4 discloses a system for pumping oil supported on the seabed, hydraulically driven by a heated driving fluid, fully incorporated into the present invention.

In oil production units, mainly in the production facilities of giant fields, there is a large consumption of seawater captured and used for injection in the reservoirs and mainly for cooling equipment and processing systems of the production unit.

Most of the water captured after cooling is returned heated to the sea, with temperatures in the order of 45 to 50° C., causing environmental impact. The water to be injected, whether desulfated or not, is also used for cooling.

Therefore, both injected water and cooling water heated have thermal potential, which under certain conditions can be used to help with flow and guarantee of flow. An example is the patent application BR 10 2013 019601-0 where the heated injection water is flowed in a "pipe-in-pipe" system to heat the oil produced, mitigating the risks of paraffin deposits in the risers and hydrates.

Thus, despite the merits of the various existing techniques for pumping systems electrically or hydraulically supported on the sea bed, the state of the art still lacks an integrated oil pumping and water injection system solution that (i) significantly optimizes the lengths of the driving fluid and pressurizing water injection lines (ii) enable, if necessary, the heating and decrease of the viscosity of the produced oil, (iii) the injection water fluid simultaneously performs the functions of driving fluid and injection fluid and (iv) improves the energy use of the production unit, transferring a greater amount of heat to the injection fluid, reducing the heat dissipated in the cooling water, reducing the environmental impact on the marine environment.

As will be better detailed below, the present invention aims at solving and optimizing the problems of the state of the art described above in a practical and efficient way.

BRIEF DESCRIPTION OF THE INVENTION

The present invention aims to provide a pumping system and method hydraulically actuated by the injection water, with eventual heating of the produced oil.

The present invention further aims to provide a hydraulically actuated pumping system and method that reduces and optimizes the lengths of subsea production and injection lines.

The present invention aims to provide a pumping and injection system and method that comprises an energy optimization of the production unit, reducing the amount of heat released into the seawater, consequently minimizing the environmental impact.

The present invention has the purpose of providing a subsea pumping system, without electrical components, such as connectors and high power electric motors, actuated by a turbine without the driving fluid mixing with the produced fluid.

Thus, in order to achieve such objectives, the present invention provides an integrated subsea pumping system hydraulically actuated by injection fluid, the system comprising at least one recoverable pumping module connected to a subsea base which, in turn, is connected to at least one producing subsea well and also connected to at least one injection subsea well. The subsea base is connected to a production unit through a riser and an injection line. The heated water, with the function of driving and injection fluid, coming from the production unit first hydraulically actuates at least one turbine and pump set, known as HSP—Hydraulic Submersible Pump, housed in the pumping module, optionally providing heat to the oil produced through a heater (heat exchanger) and is finally injected through injection wells.

The present invention further provides an integrated method of subsea pumping hydraulically actuated by injection fluid, the method comprising the steps of (i) hydraulically driving a pump housed in the pumping module through driving fluid from a production unit, (ii) pumping the production fluid, (iii) eventually providing heat to the oil produced and (iv) injecting water into the injection well.

BRIEF DESCRIPTION OF THE DRAWINGS

The detailed description disclosed below makes reference to the accompanying figures and their respective reference numbers, representing non-limiting examples of embodiments of the present invention.

FIG. 2A schematically illustrates a first embodiment of a subsea heating and pumping system hydraulically actuated by injection water comprised of two modules: one for heating, one for pumping and a subsea base.

FIG. 2B illustrates a second embodiment of a subsea pumping system hydraulically actuated by injection water comprising a single pumping module, without heating.

FIGS. 5A, 5B and 5C schematically illustrate some of the possible pump module and heating module arrangements in accordance with the present invention.

DETAILED DESCRIPTION OF THE INVENTION

Preliminarily, it should be noted that the description that follows will be based on preferred embodiments of the present invention, applied to a subsea heating and pumping system interconnected to at least one oil producing well, to at least one water injection well and to a unit of floating production, for example an FPSO.

As will be evident to anyone skilled in the art, however, the invention is not limited to these particular embodiments, but can also be applied to other types of production units, such as Spar, TLP, Semi-sub, among others.

Figure 1:
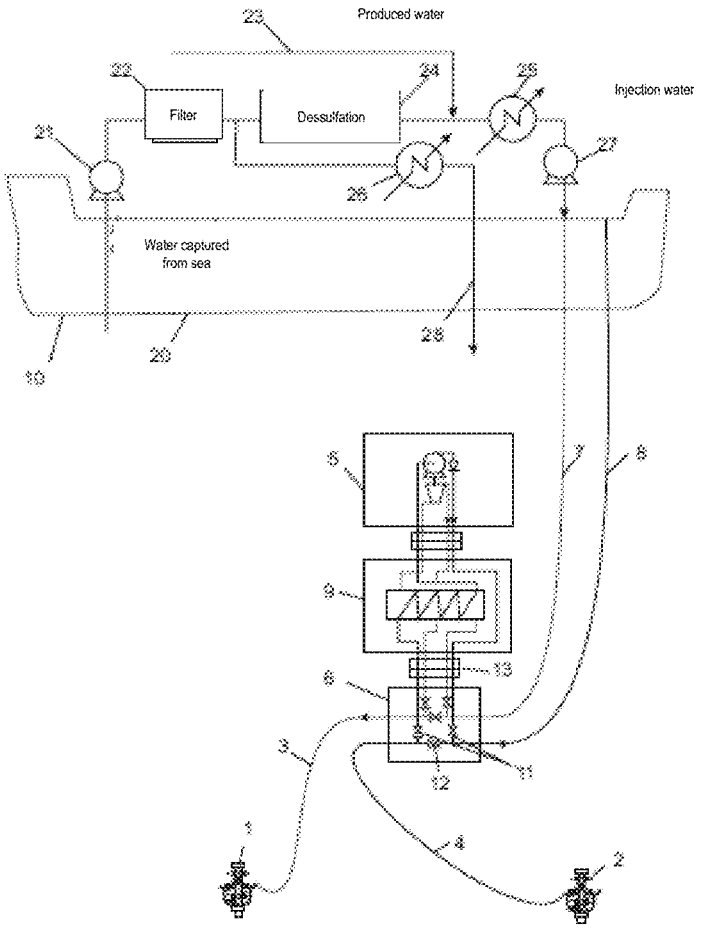
FIG. 1 shows a simplified flowchart of an embodiment of an integrated subsea pumping system hydraulically driven by heated injection water in accordance with the present invention.

FIG. 1 illustrates a flowchart of a subsea heating and pumping system hydraulically actuated by heated injection water, which comprises a subsea base (6) on which at least one pumping module (5) is supported and connected, a module of heating (9), recoverable.

The subsea base (6) is connected to at least one producing subsea well (2) receiving the fluid produced by at least one production line (4). The subsea base (6) is connected to at least one injection subsea well (1) through at least one injection line (3), which injects water to maintain the pressure of the production reservoir. The subsea base (6) is also hydraulically connected to a production unit (10) by a riser (8) and an injection line (7).

The injection line (7) feeds the heater (14) with injection water, heating the produced oil. The injection water also actuates the turbine (15) which in turn drives a pump (16), which sucks in and transfers energy in the form of pressure to the oil produced. After activating the turbine, water is injected through the injection well (1).

The production unit (10) comprises, interconnected with each other, a seawater capture pipe (20), a seawater pump (21), a filter (22), a produced water pipe (23), a desulfation unit (24), main heat exchanger (25), secondary heat exchanger (26), injection pump (27), cooling water discharge pipe to sea (28).

In a first preferred embodiment of the present invention, illustrated in FIG. 2A, a subsea heating and pumping system is composed of at least one pumping module (5), where a centrifugal pump (16) is actuated by a turbine (15), connected through a seal or magnetic coupling (19). The pump module (5) is hydraulically connected to a heating module (9) and this to a subsea base (6). The pump suction line (29), the pump discharge line (30), the turbine supply line (31) and the turbine discharge line (32) are further illustrated.

Optionally, a heating module (16) provides heat to the produced fluid, facilitating the flow by decreasing the viscosity and mitigating the risks of clogging the production line (4) by deposits of paraffins or hydrates.

The fluid produced from the producing subsea well (2) arrives at the subsea base (6) through the production line (4).

The heated injection water from the production unit (10) reaches the subsea base (6) through the injection line (7). This heated injection water has the functions of (i) providing hydraulic energy for the operation of the turbine (15), which actuates the centrifugal pump (19), and (ii) heating the oil produced, reducing its viscosity and risks of flow guarantee.

In any embodiment, the connector (13) is separable into two parts. This allows the modules to be easily removed for maintenance or replacement by simply detaching the connector (13).

Preferably, the pumping module (5), the heating module (9) and the heating and pumping module (18) are mounted on a structure, such as a skid, facilitating transport and installation by a simpler, lower smaller vessel.

Stop valves (11) may be provided in any flow line of the system of the present invention, such as pump suction line (29), pump discharge line (30), turbine feed line (31) and turbine discharge (32). Such block valves (11) allow to correctly direct and control the flow of fluids in the system. Additionally, said blocking valves (11) allow blocking of the fluid lines in case of disconnection of the pumping module (5) or heating module (9) from the subsea base (6).

Optionally, a diverter valve (bypass) (12) is provided at the boundary between the production line (4) and the riser (8) to allow the passage of pig, as illustrated in the figures.

FIG. 2B shows that in certain characteristics of produced oil and flow conditions, where it is not necessary to heat the oil, the heating module (9) can be suppressed, and the pumping module (5) can be directly coupled with the subsea base (6).

In this way, and preferably, the pumping module (5), the heating module (9) and the subsea base (6) are connected through connectors (13).

Figure 3:
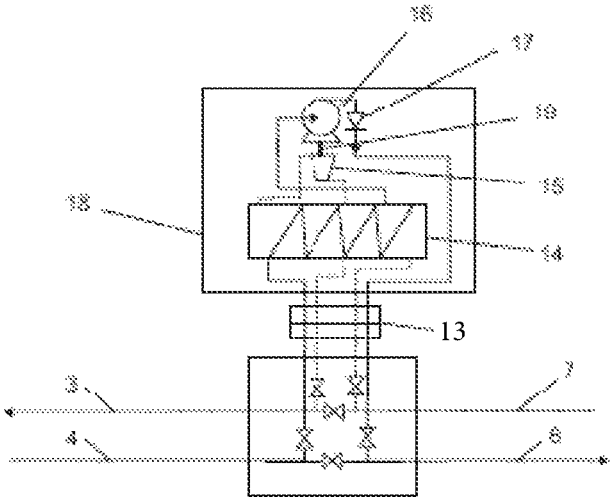
FIG. 3 illustrates a third embodiment of a subsea pumping system hydraulically actuated by injection water comprising a single pump module integrated with heating.

FIG. 3 illustrates a third embodiment of a subsea pumping system hydraulically actuated by injection water composed of a single pumping and heating module, integrating the pump (16) and heater (14) components in a single structure.

Figure 4:
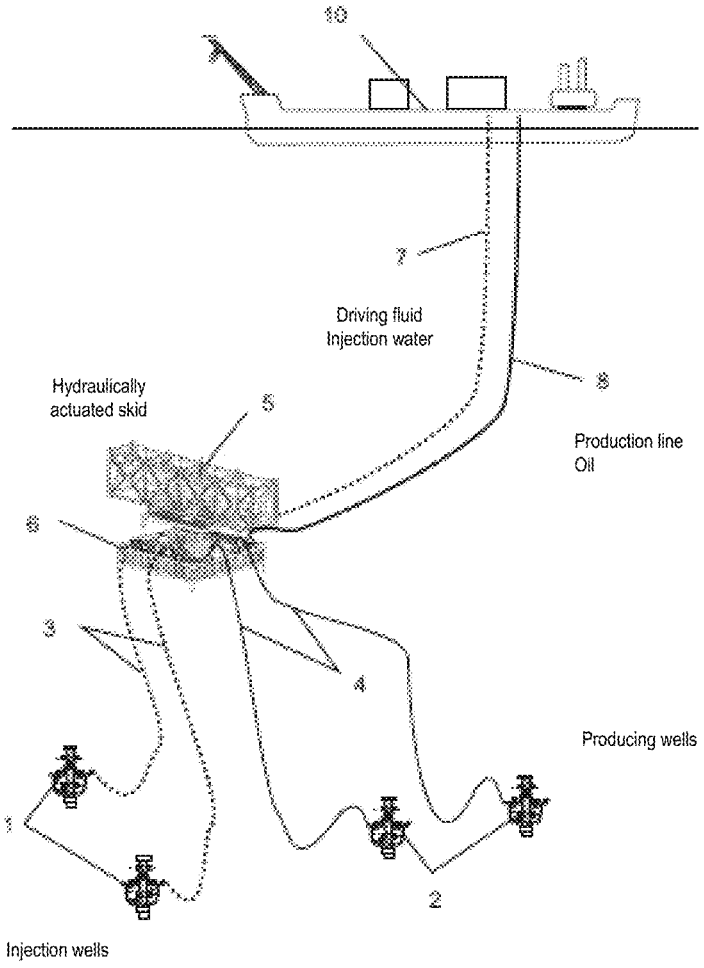
FIG. 4 schematically illustrates a subsea arrangement of a subsea pumping system hydraulically actuated by injection water connected to two producing wells and two injectors, according to the present invention.

FIG. 4 schematically illustrates a subsea arrangement of a subsea pumping system hydraulically actuated by injection water connected to two producing wells (2) and two injectors (1), according to the present invention.

FIG. 5A illustrates an arrangement with a single module, pumping only (5), or heating only (9), or integrated heating and pumping (18) integrated connected to a subsea base (6).

FIG. 5B illustrates an arrangement with two modules, one for heating (9) and one for pumping (5), stacked and connected to a subsea base (6).

FIG. 5C illustrates an arrangement with two modules of either type (5) or (9) or (18), juxtaposed, so that they can be installed and removed independently.

The present invention further provides a hydraulically actuated subsea pumping method comprising the steps of:

(i) hydraulically actuating a pump (19, 22) housed in the pumping module (5) through driving fluid from the production unit (10) through the injection line (7);

(ii) pumping, by means of the pumping module (5), the produced fluid;

(iii) optionally heating the produced oil through the heater (14);

(iv) injecting water through at least one injection well (1) to maintain the oil reservoir pressure.

Optionally, the method of the present invention comprises the additional step of heating the mixture of driving fluid and production fluid in the pump module (5) by means of the at least one heating element (14).

Therefore, the pumping system of the present invention based on hydraulic actuation, with pump (16) actuated by turbine (15), in addition to providing energy in the form of pressure, provides energy in the form of heat. This property is extremely valuable for the production of highly viscous heavy oils. The temperature increase is also beneficial for scenarios of deep water fields with high gas-liquid ratios with waxing problems of risers due to the Joule-Thomson effect of gas depressurization.

In addition, pumps hydraulically actuated by high-speed hydraulic turbines are significantly shorter than electrically actuated pumps type BCS for the same power, making it easier to build pumping modules with reduced dimensions, easily installed by smaller and more common vessels, more easy to hire and mobilize.

Additionally, hydraulically actuated pumps do not need all subsea electrical components, components that have greatly contributed to the failures of BCS systems and other subsea pumps.

Numerous variations within the scope of protection of this application are permitted. Thus, it is emphasized the fact that the present invention is not limited to the particular configurations and embodiments described above.

The invention claimed is:

1. INTEGRATED SUBSEA OIL HEATING AND PUMPING SYSTEM AND WATER INJECTION FOR RESERVOIR PRESSURIZATION, characterized by comprising:

at least one recoverable pumping module;

at least one producing subsea well through at least one production line which flows produced oil;

at least one injection subsea well through at least one injection line; and a base that connects a production unit through a riser and an injection line, wherein injection fluid corresponding to water, from the production unit through the injection line:

hydraulically actuates a pump residing in the pumping module; and is injected into the injection well, and wherein the SYSTEM is characterized by further comprising a heating module.

2. SYSTEM, according to claim 1, characterized in that the heating module comprises a heater, and the heater is integrated with the pumping module itself.

3. SYSTEM according to claim 1, characterized in that the injection fluid is preheated in the production unit.

4. SYSTEM according to claim 2, characterized in that the injection fluid is preheated in the production unit.

* * * * *